United States Patent [19]

Shigaki

[11] Patent Number: 4,512,266

[45] Date of Patent: Apr. 23, 1985

[54] CITY REFUSE INCINERATOR FOR THE PREVENTION OF CLINKER FORMATION

[75] Inventor: Masanobu Shigaki, Ibaragi, Japan

[73] Assignee: Kabushiki Kaisha Takuma, Osaka, Japan

[21] Appl. No.: 594,005

[22] Filed: Mar. 27, 1984

[30] Foreign Application Priority Data

Mar. 30, 1983 [JP] Japan ..... 58-56270

[51] Int. Cl.[3] ..... F23B 5/02; F23K 7/04

[52] U.S. Cl. ..... 110/204; 110/206; 110/216; 110/283; 110/291

[58] Field of Search ..... 110/203-207, 110/215-217, 283, 288, 291, 300, 343

[56] References Cited

U.S. PATENT DOCUMENTS

| | | | |
|---|---|---|---|
| 1,393,979 | 10/1921 | Skelly | 110/283 |
| 1,664,082 | 3/1928 | Mildon | 110/291 |
| 2,561,717 | 7/1951 | Vicard | 110/291 |
| 3,117,537 | 1/1964 | Mitchell et al. | 110/206 |
| 3,877,440 | 4/1975 | Winkin | 110/343 |
| 4,170,183 | 10/1979 | Cross | 110/291 |
| 4,182,274 | 1/1980 | Williams | 110/204 |
| 4,270,467 | 6/1981 | Drake | 110/216 |
| 4,356,778 | 11/1982 | McRee, Jr. | 110/212 |
| 4,452,152 | 6/1984 | John et al. | 110/291 |

*Primary Examiner*—Henry C. Yuen

*Attorney, Agent, or Firm*—Griffin, Branigan & Butler

[57] ABSTRACT

A city refuse incinerator provided with stoker type firing equipment for combustion of city refuse has gas injectors installed low on the inside of a furnace body to inject low temperature inert combustion exhaust gas, purified in a dust collector, so that a gas curtain is formed on the inner surface of side walls of the furnace by the low temperature inert gas, thus preventing the formation of clinkers.

1 Claim, 4 Drawing Figures

CITY REFUSE INCINERATOR FOR THE PREVENTION OF CLINKER FORMATION

BACKGROUND OF THE INVENTION

The present invention relates to a new type of city refuse incinerator with which the formation of clinkers inside a furnace body is easily and thoroughly prevented.

Due to remarkable recent improvements in living standards and the extensive use of plastics, refuse from households, plants, etc. (hereinafter called city refuse), contains a large amount of waste plastic materials, thus making the calrolific value of refuse especially high.

However, when refuse with such a high calorific value is given a combustion treatment, clinkers such as melted ash, etc., are formed on sidewalls of a furnace body due to an elevated temperature inside the furnace, thus making continuous operation of an incinerator difficult.

To avoid such a problem relating to clinkers as stated above, a means of preventing the formation of clinkers has been employed in which excessive temperature rises of the sidewalls of a furnace are suppressed by means of employing a wall structure with water-wall tubes at the sidewall area of the furnace body (so-called clinker zone) where clinkers tend to be easily formed. Also, a means of preventing the formation of clinkers by reducing the temperature of sidewalls of a furnace using a water gas reaction caused by steam sprayed along the surface of sidewalls of the furnace from both sides of stoker type firing equipment has been conventionally employed.

It is relatively easy to employ such methods to prevent the formation of clinkers as stated above with a city refuse incinerator equipped with a waste heat boiler.

However, in the case of a small or medium size city refuse incinerator which is not equipped with a waste heat boiler, it is not easy to employ such methods to prevent the formation of clinkers as stated above due to high installation costs.

That is, an extra steam generation device is required when steam is sprayed onto the sidewalls of a furnace, while a cooling water circulation device or a water cooling device are required in the case of changing an ordinary furnace wall to a water-wall.

Due to these extra requirements, small and medium size refuse incinerators not equipped with a waste heat boiler are not usually provided with a clinker formation preventing device, thus causing various kinds of problems that cause difficulties in operating these incinerators due to the formation of clinkers.

SUMMARY OF THE INVENTION

The present invention is a novel means to solve clinker-related problems with a city refuse incinerator without using steam or changing an ordinary furnace wall into a water-wall structure.

It is a first object of the present invention to provide a city refuse incinerator in which the formation of clinkers is easily and accurately prevented regardless of the existence of a waste heat boiler.

It is a second object of the present invention to provide a city refuse incinerator in which the formation of clinkers is thoroughly prevented without causing a large increase of its construction cost.

In accomplishing the aforementioned objectives, a city refuse incinerator of the present invention comprises a furnace body equipped with stoker type firing equipment for burning refuse, a dust collector to purify combustion gas generated inside the furnace body, a circulation fan to bring back low temperature exhaust gas purified by treatment in the aforementioned dust collector, and gas injectors to inject the low temperature inert exhaust gas sucked by the aforementioned circulation fan along the inner surface of sidewalls of the furnace where clinkers tend to be easily formed.

With a city refuse incinerator of the present invention, a gas curtain is formed by the low temperature inert gas injected from gas injectors along the inner surface of the side walls of the furnace. When the gas curtain is formed, combustion of refuse is suppressed in the vicinity of the surface of the sidewalls of the furnace because the gas forming the curtain is an inert gas the temperature of which is low. Also cooling of the sidewalls of the furnace is further enhanced because of the flow of the gas forming the gas curtain.

As a result, clinkers are not formed on the sidewalls of the furnace because ash floating inside the furnace body does not melt and adhere to the surface of the sidewalls of the furnace.

In addition, when combustibles such as pieces of paper or plastics, blown up inside the incinerator, adhered to the surface of the sidewalls of the furnace, are combusted, its melted ash does not adhere to the sidewalls of the furnace and hence is not accumulated thereon, thus eliminating the formation of clinkers.

Continuous operation of the incinerator under stable condition over a long period of time is assured because formation of clinkers on surface of the sidewalls is thoroughly prevented, thus resulting in smooth operation of such stoker type firing equipment and stable combustion of refuse.

DETAILED DESCRIPTION OF THE INVENTION

A city refuse incinerator according to the present invention is hereafter explained in conjunction with the drawings illustrating an embodiment thereof.

Figure 1:
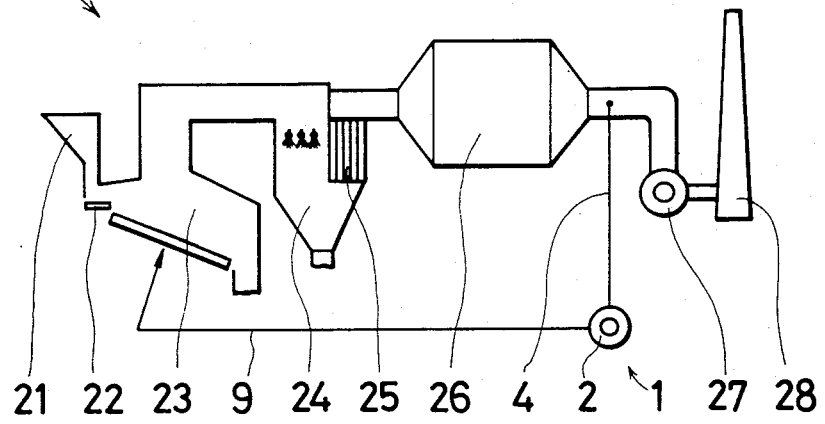
FIG. 1 is a schematic representation illustrating the entire structure of a city refuse incinerator embodying the present invention.

FIG. 1 is a schematic representation illustrating an entire structure of a city refuse incinerator according to the present invention. As illustrated in FIG. 1, a city refuse incinerator 20 comprises a refuse hopper 21, a refuse supply feeder 22, a furnace body 23, water injection desuperheating device 24, an air heater 25, a dust collector 26, an induced draft fan 27, and a smoke stack 28.

Figure 2:
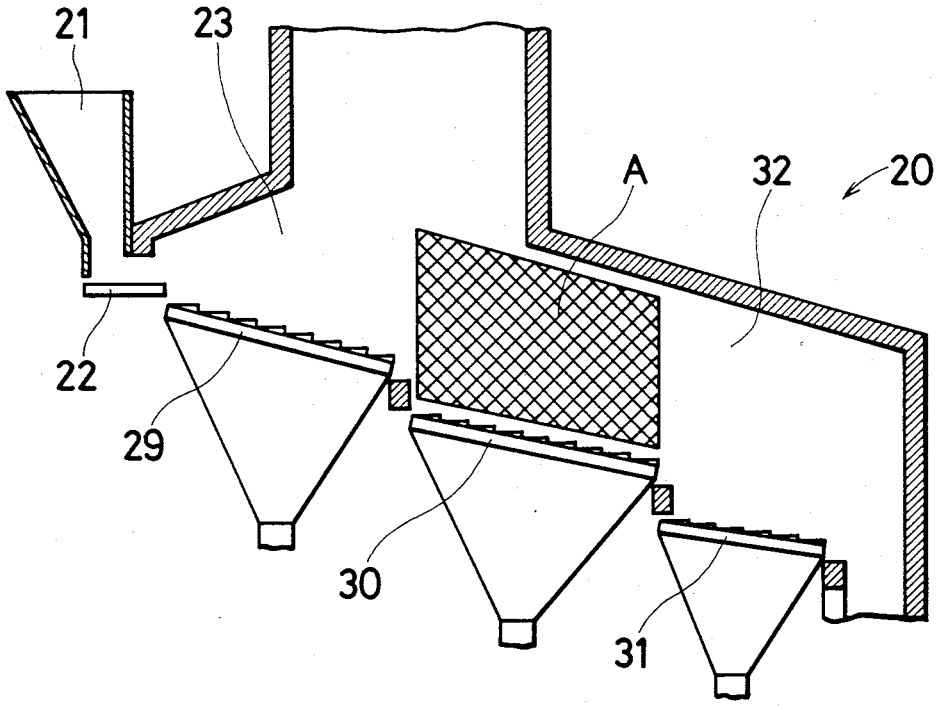
FIG. 2 is an enlarged schematic representation illustrating a structure in the vicinity of a furnace body, and also showing a clinker zone.

As illustrated in FIG. 2, the furnace body 23 is equipped with a refuse dry stoker 29, a combustion stoker 30 and a post-combustion stoker 31.

Clinkers tend to be easily formed on sidewalls 32, 32 in the vicinity of the combustion stoker 30 in the furnace body 23. This area is hereinafter called a clinker zone A.

The main part of a clinker prevention device 1 applicable to such a city refuse incinerator 20 comprises a circulation fan 2 and gas injectors 3.

A comparatively low temperature exhaust gas cleaned by treatment in the dust collector 26 is sucked by the circulation fan 2, an inlet opening thereof and an outlet opening of the dust collector 26 being connected by means of a pipe 4.

An exhaust gas cleaned in the aforementioned dust collector 26 is an inert gas containing a large quantity of carbonic acid gas and very little oxygen, and its temperature is reduced to a comparatively low temperature range of approximately 200° C.–250° C. by means of the water injection desuperheating device 24 and the air heater 25.

A gas curtain is formed by a low temperature inert gas injected through gas injectors 3 placed on the inside of the sidewalls 32 of the furnace. The gas injectors should preferably be fixed between the sidewalls 32 and the combustion stoker 30.

Figure 3:
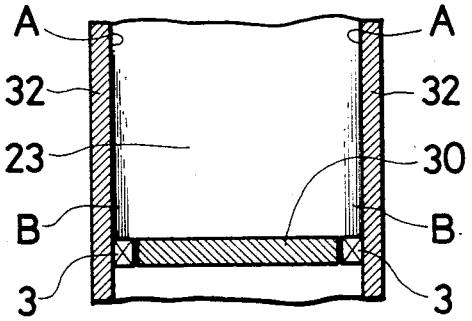
FIG. 3 is a vertical schematic view illustrating how injectors are installed in an embodiment of this invention; and, FIG. 4 is a perspective view illustrating the structure of gas injectors of this invention.
Figure 4:
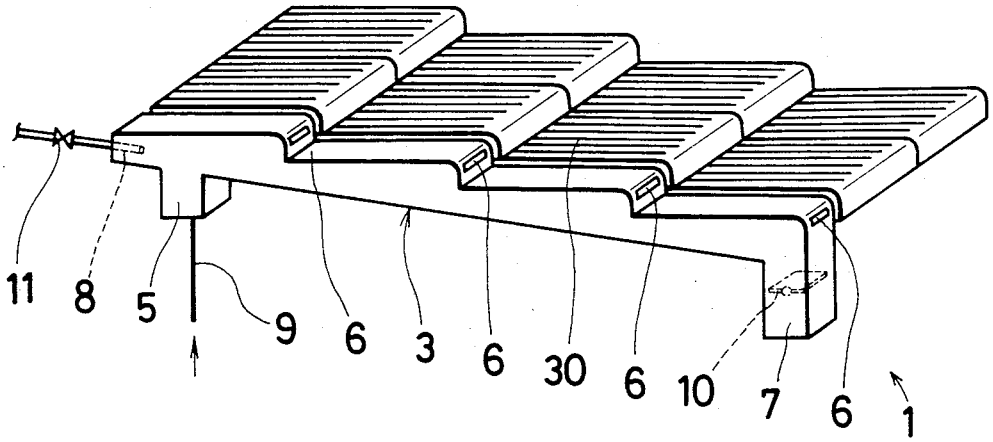

As illustrated in FIGS. 3 and 4, gas injectors 3 are designed like a box and also in step fashion corresponding to the side shape of the combustion stoker 30.

A gas inlet opening 5 is mounted in the rear of and under the aforementioned gas injectors 3 (on the left side in FIG. 4) and laterally extended slit-type injection openings 6 are in the front face of each step. A foreign matter discharge opening 7 is in the front and under the gas injectors 4, and an air nozzle 8 is in the rear of the gas injectors 3.

The gas inlet opening 5 and a discharge opening of the circulation fan 2 are connected by means of a pipe 9, while a damper 10 is placed in the foreign matter discharge opening 7. A compressor (not illustrated) is connected to an air nozzle 8 via a valve 11.

Next, the function under such a construction will be explained.

City refuse fed through the refuse hopper 21 is carried to the furnace body 23 by means of the refuse supply feeder 22, and combusted progressively on the dry stoker 29, the combustion stoker 30 and the post-combustion stoker 31 in the furnace body 23.

Through the water injection cooling chamber 24 and the air heater 25, combustion exhaust gas generated by combustion reaches the dust collector 26 where dusts are removed. The exhaust gas is discharged through the smoke stack 28 by means of the draft fan 27, but a part of the exhaust gas is sucked by the circulation fan 2 and led into the gas injectors 3.

Dusts are removed from the exhaust gas while it is treated in the dust collector 26. The cleaned gas with a temperature of about 200° C.–250° C. turns inert.

Gas curtains B are formed when the low temperature inert gas led to the gas injectors 3 is injected through gas injection openings upwards along inner surface of the sidewalls 32 of the furnace.

At the clinker zone A, the sidewalls 32 of the furnace are covered with gas curtains, thus preventing the formation of clinkers on said sidewalls 32 of the furnace.

That is to say, since ash floating inside the furnace body 23 does not adhere to side walls 32 of the furnace when melted by combustion, clinkers are not formed. Also, since ash produced by combustion of the combustibles in city refuse blown up in the incinerator does not adhere to the sidewalls 32 of the furnace, there is no formation of clinkers by accumulation of ash.

To remove foreign matter finding its way into gas injectors 3 through gas injection openings 6, cleaning is conducted from time to time by opening the valve 11 and the damper 10 and sending compressed air into the gas injectors through the air nozzles 8 so as to discharge the foreign matter from the foreign matter discharge opening 7, thus ensuring a smooth injection of low temperature inert gas and allowing continuous operation of the incinerator.

In the embodiment described above, gas injectors 3 are installed between the sidewalls 32 of the furnace and the combustion stoker 30. However, gas injectors are not limited to such a position. They can be installed at any desired position where a gas curtain B will be formed along the inner surface of the sidewalls 32 of a furnace.

Gas injectors 3 are constructed like a box in which a gas inlet opening 5 and gas injection openings 6 are arranged. However, gas injectors are not limited to such a construction. For examle, gas injectors may be so constructed that many nozzles are mounted on a gas induction pipe.

What is claimed is:

1. A city refuse incinerator for the prevention of clinker formation comprising a furnace body having a sidewall, said refuse incinerator being provided with stoker type firing equipment for moving refuse through said furnace body, and an inert gas circuit comprising: gas injection positioned in said furnace body and directed to inject gas into said furnace body adjacent said sidewall, a dust collector means coupled to said furnace to receive and purify a combustion gas led from the furnace body, a temperature reducing means for lowering the temperature of the combustion gas passing through the dust-collector means and a circulation fan for supplying this purified low temperature inert combustion gas from the dust-collector means to the gas injectors, said gas injectors injecting said inert gas to form a gas curtain concentrated at the inside of said sidewall of the furnace body to thereby inhibit the formation of clinkers on said sidewall;

said gas injectors being formed by a gas injector apparatus which includes a hollow pipe member installed between said stoker type firing equipment inside the furnace body and the sidewall of the furnace body, the upper side of said hollow pipe member having steps shaped thereon with injection openings in the front faces of said steps, said hollow pipe member further having a gas inlet opening for receiving said purified low temperature inert combustion gas from said dust collector, a selectively operated valved foreign matter discharge opening downstream of said injection openings and a selectively operated valved pressurized air source upstream of said injection openings, whereby said valved foreign matter discharge opening and said selectively operated valved pressurized air source are normally closed to allow said purified low temperature inert combustion gas entering from said gas inlet opening to be passed through said injection openings but being selectively opened for sending compressed air through the hollow pipe member so as to drive foreign matter from the hollow pipe through the foreign matter discharge opening.

* * * * *